United States Patent [19]

Chymiak

[11] Patent Number: 4,689,634

[45] Date of Patent: Aug. 25, 1987

[54] MOUNT FOR FEEDHORN/LNA ASSEMBLY

[76] Inventor: Michael V. Chymiak, Rte. 2, Box 140C, Cuba, Mo. 65453

[21] Appl. No.: 718,156

[22] Filed: Apr. 1, 1985

[51] Int. Cl.[4] ..... H01Q 1/12

[52] U.S. Cl. ..... 343/840; 343/880

[58] Field of Search ..... 343/840, 878, 880, 881, 343/882

[56] References Cited

U.S. PATENT DOCUMENTS 3,832,717 8/1974 Taggart ..... 343/840

3,983,562 9/1976 Blanchard et al. ..... 343/840

4,538,175 8/1985 Balbes et al. ..... 343/840

4,590,481 5/1986 Burditt ..... 343/840

*Primary Examiner*—Eli Lieberman

*Attorney, Agent, or Firm*—Grace J. Fishel

[57] ABSTRACT

A mount for supporting a feedhorn/LNA assembly in a parabolic satellite antenna is disclosed, said mount providing a sturdy support for positioning the feedhorn/LNA assembly at the focal point of the antenna and providing means for skew adjustment of the LNA probe.

5 Claims, 4 Drawing Figures

MOUNT FOR FEEDHORN/LNA ASSEMBLY

The present invention relates to an improved mount for supporting a feedhorn/LNA assembly in a parabolic satellite antenna.

The signals received by a satellite antenna are very weak since satellites typically transmit from an orbit 22,000 miles over the equator, with only 5 to 8 watts of power and beam the signal over a wide geographic area. Parabolic satellite antennas operate by concentrating the very weak signals received from a large area and reflecting them back to a central point above the center of the dish called the focal point. A feedhorn is located at the focal point to gather the reflected signals and to conduct them to a low noise amplifier (LNA). Centered within an opening in the LNA is a metal probe which picks up the combined signals gathered by the feedhorn and conducts them to the LNA for amplification.

A parabolic satellite antenna must be pointed at the satellite to be received. When the feedhorn/LNA assembly is attached to the face of the parabolic antenna and the antenna is pointed at a satellite, the support for the feedhorn/LNA assembly is at an inclination such that the center of gravity for the assembly falls outside the base of the support. A sturdy support structure is important under these circumstances since being off the focal point by an inch or two can be critical and make the difference between a good picture and no picture at all. Buttonhooks, which use only one support member, and tripods have been used in the past but no support has been found entirely satisfactory.

Satellite signals are polarized either in a vertical or horizontal plane. For best reception of the signals, the LNA's antenna probe must be oriented in the same plane. No mount provides an easy means for making this necessary adjustment.

In view of the above, it is an object of the present invention to provide a solid support for positioning a feedhorn/LNA assembly at the focal point of a parabolic satellite antenna. Another object is to provide easy skew adjustment of the LNA probe. Other objects and features will be in part apparent and in part pointed out hereinafter. The invention accordingly comprises the structures hereinafter described, the scope of the invention being indicated by the subjoined claims.

In the drawings, in which one of various possible embodiments of the invention is illustrated and in which corresponding reference characters refer to corresponding parts:

Figure 1:
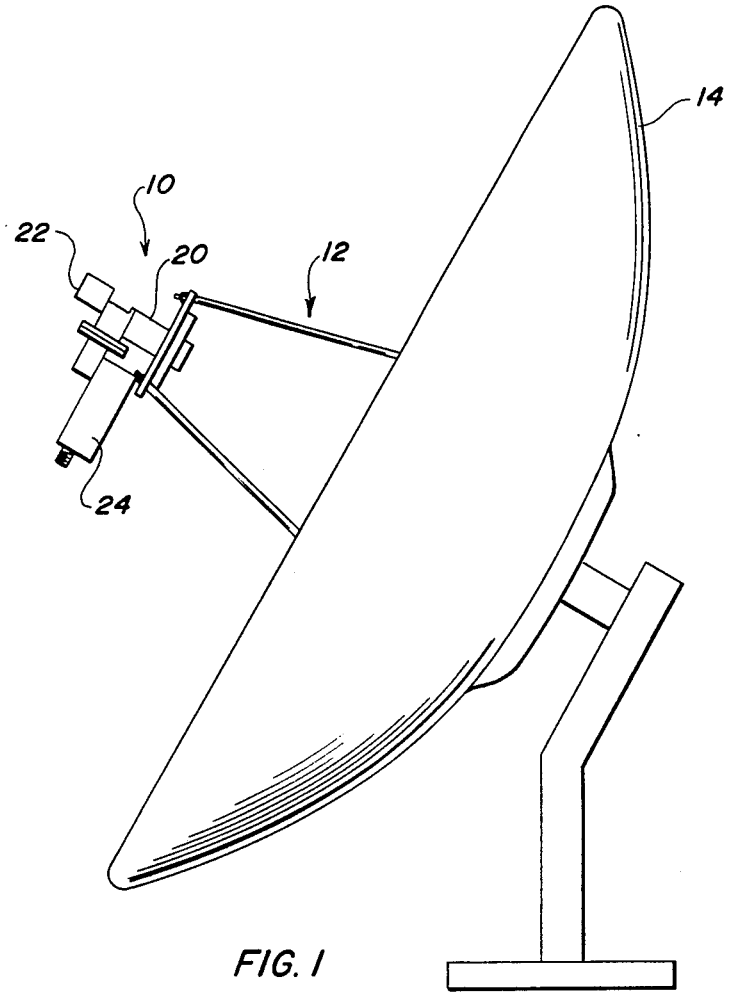
FIG. 1 is a side elevational view of a parabolic satellite antenna with a support for the feedhorn/LNA assembly in accordance with the present invention.

Referring to the drawings more particularly by reference character, reference numeral 10 refers to a feedhorn/LNA assembly mounted on a platform 12 in the bowl of a parabolic satellite antenna 14. For the purpose of providing a sturdy support, while allowing for skew adjustment of the LNA probe as more particularly described below, platform 12 is generally frustopyramidal. As shown in the drawings, platform 12 has a frustrum

16 which serves as the mounting plate for feedhorn/LNA assembly 10 and is supported by three legs 18. It may have more than three legs, in which case the base of platform 12 is square or polygonal other than triangular. Mounting plate 16 is preferably formed of a wood product such as Benelex 402, masonite or some other thermally non-conductive material since heat can interfere with the electronic components above the platform and cause sparklies in the picture. Legs 18 are of such a length to position feedhorn/LNA assembly 10 over the center of parabolic satellite antenna 14 at the required distance for maximum concentration of the signal.

Figure 2:
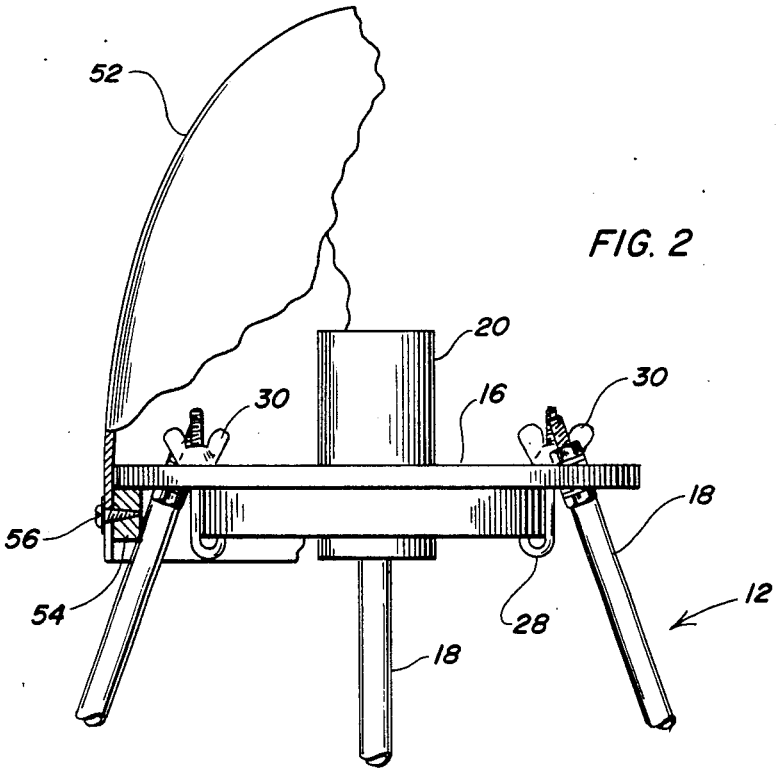
FIG. 2 is an enlarged side elevational view of the support but with the LNA removed and a weather dome shown partially broken away.
Figure 3:
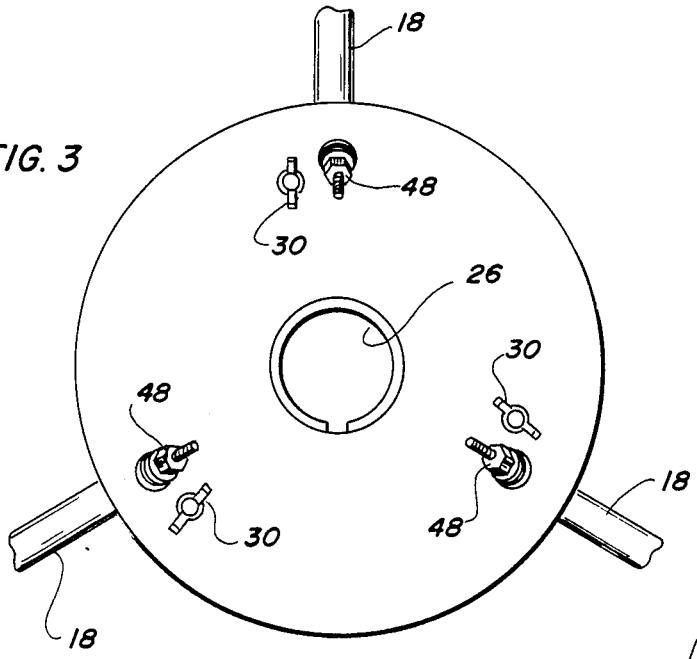
FIG. 3 is a plan view of the support shown in FIG. 2 but with the feedhorn and weather dome removed; and, FIG. 4 shows a leg assembly for the support in exploded detail.

The particular feedhorn/LNA assembly 10 shown in FIG. 1 includes a feedhorn 20, servomotor 22 and a LNA 24. As best seen in FIGS. 2 and 3, mounting plate 16 has a central aperture 26 through which the upper portion of feedhorn 20 extends for attachment to LNA 24.

Feedhorn 20 is suspended from mounting plate 16 by a plurality of J-hooks 28, preferably symmetrically disposed about the mounting plate. Each of J-hooks 28 has a threaded shank which extends through a hole in mounting plate 16 for attachment to a wing nut 30 by which it depends.

Figure 4:
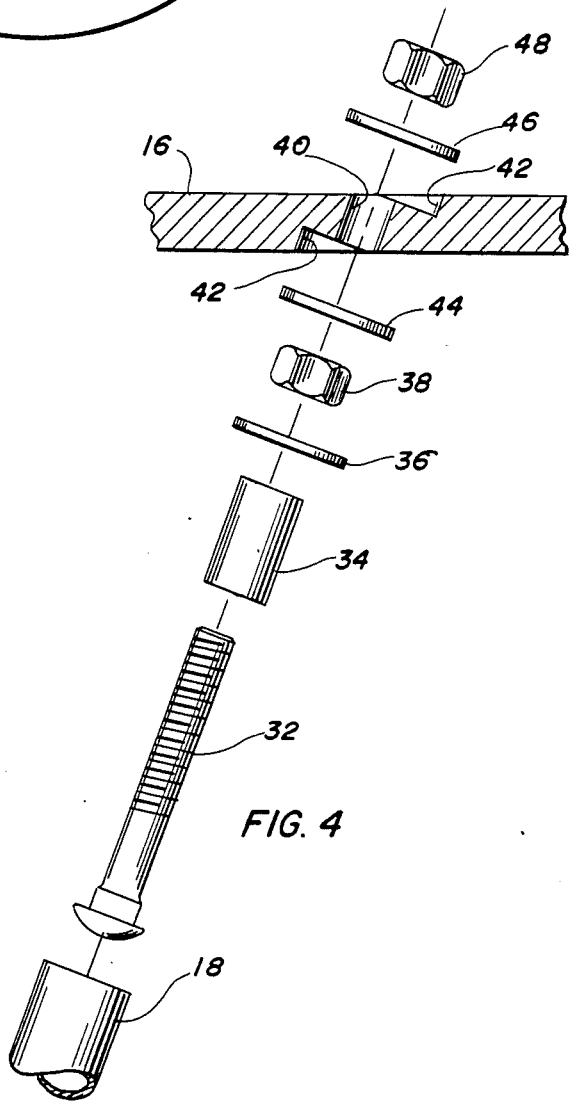

Legs 18 are attached to mounting plate 16 at an acute angle such as about 20 degrees to perpendicular and at an angle to each other such that if the legs were extended above the mounting plate they would converge at the truncated apex of platform 12. When the legs are made of conduit as shown in FIG. 4, the ends of each leg are outfitted with a compression fitting including a bolt 32, compression tube 34, washer 36 and nut 38.

Holes 40 are drilled in mounting plate 16 at the same angle as the angle that legs 18 are raked before they are tensioned in place in dish 14. A counter hole 42 with a flat bottom and an inside diameter the same as the diameter of washers 44 and 46 is drilled over both ends of each hole 40. As shown in FIG. 4, washers 44 and 46 are mounted on bolt 32 on opposite sides of mounting plate 16 and a nut 48 is provided for tightening up the assembly.

To install platform 12 in a parabolic satellite antenna 14, it is necessary to know the focal length (F) of the dish. If this length is not known, it may be determined using the formula: $F=d^2/16H$ where D is the dish diameter in inches and H is the dish depth in inches. Once F is determined, the length of legs 18 can be determined.

To provide the desired amount of tension on legs 18, the mounting holes in satellite antenna 14 are drilled further from the focal point than legs 18 are spaced. Usually an inch or two at each hole is sufficient for this purpose. A triangle is made from material such as plywood for use as a drilling jig. The triangle is positioned so that all points are equidistant from the edge of the dish and preferably so that one point is at the 12 o'clock position on the dish. The triangle points are marked on the dish and holes are drilled through the dish at these points for installation of tripod legs 18.

Pressure is applied to mounting plate 16 and to legs 18 while the legs are installed in the mounting holes. As this is done, the legs are bowed, washer 46 is pushed inwardly at the top of each leg and washer 44 is pushed outwardly into the sides of counter holes 42. This serves to spread the load over washers 44 and 46 and to spring load the legs tending to push the mount to the correct center position. Washers 44 and 46 also prevent side wobbling of the legs in mounting plate 16 since they are confined from lateral movement in counter holes 42.

Mounting plate 16 is attached to the upper end of each leg 18 by bolt 32 with washers 44 and 46 and nut 48. Mounting plate 16 is illustrated with the central aperture 26 specifically adapted to fit the neck of Chaparral feedhorn 20 but it can be made larger to fit any brand of feedhorn.

The top portion of feedhorn 20 is removed and the base slipped up through aperture 26. Wing nuts 30 are loosened such that J-hooks 28 can be hooked over the polarotor ring of feedhorn 20 and then tightened. The top portion of feedhorn 20 is reinstalled. LNA 24 is then attached to feedhorn 20 and the LNA cable (not shown) is dressed down one leg of the tripod.

The skew adjustment on the polarization probe can be easily made by loosening wing nuts 30 on J-hooks 28 such that the polarotor ring of feedhorn 20 can be rotated. Once polarity has been matched with a signal received from one satellite, the J-hooks are locked down on the polarotar ring and further adjustments are made by servomotor 22 as are necessary when the antenna is switched from satellite to satellite or the receiver is changed from channel to channel. The mechanical adjustment of the polarization probe provided by the present invention is not necessary with those polarization devices which can rotate the probe a full 360 degrees or with some polarization devices which are electronically polarized. When the LNA is particularly heavy, the feedhorn may be permanently attached to mounting plate 16 after the skew adjustment has been made by means of screws, bolts or the like (not shown).

A weather dome 52 is preferably installed over feedhorn/LNA assembly 10. As shown in FIG. 2, dome 52 generally comprises a truncated ellipsoid, the circular base of which is sized to slip fit over mounting plate 16. Dome 52 includes a boot portion (not shown) to accommodate a horizontally mounted LNA 24. Spaced about the periphery of mounting plate 16 are mounting blocks 54 by means of which dome 52 is attached with screws 56.

In view of the above, it will be seen that the several objects of the invention are achieved and other advantageous results attained. As various changes could be made in the above constructions without departing from the scope of the invention, it is intended that all matters contained in the bove description shall be integrated as illustrative and not in a limiting sense.

What is claimed is:

1. A mount for a feedhorn/LNA assembly in a parabolic satellite antenna which comprises a frustopyramidal platform having three legs and a thermally nonconductive mounting plate, said legs attached to the mounting plate at an acute angle to perpendicular to the mounting plate on bolts passing through the mounting plate at the same angle as the legs are raked before they are installed in said antenna and said legs attached to the satellite antenna further from the focal point than the legs are normally spaced whereby said mount is tensioned; said mounting plate provided with a counter hole on both sides of the mounting plate in alignment with each leg bolt for receipt of a means for spreading the load whereby the load by each leg is spread over a wider area of the mounting plate.

2. The mount of claim 1 wherein the means for spreading the load is a washer.

3. The mount of claim 1 wherein the feedhorn/LNA assembly depends from the mounting plate on a plurality of J-hooks through an aperture therein.

4. The mount of claim 3 wherein the shank of each J-hook is threaded and extends through the mounting plate for attachment to a nut by which it depends.

5. The mount of claim 4 wherein the mounting plate is circular for easy and rigid installation of a weather dome having a circular base.

* * * * *